US005445518A

United States Patent [19]

McDonough et al.

[11] Patent Number: 5,445,518

[45] Date of Patent: * Aug. 29, 1995

[54] SELECTIVELY ACTUATABLE LIGHTER

[75] Inventors: James M. McDonough, Guilford; Chris A. Barone, Trumbull, both of Conn.; Michel Doucet, Bains/S/Oust Redon, France

[73] Assignee: BIC Corporation, Milford, Conn.

[ * ] Notice: The portion of the term of this patent subsequent to Mar. 26, 2008 has been disclaimed.

[21] Appl. No.: 965,831

[22] Filed: Oct. 23, 1992

Related U.S. Application Data

[63] Continuation-in-part of Ser. No. 723,989, Jul. 1, 1991, and a continuation-in-part of Ser. No. 912,421, Jul. 10, 1992, which is a continuation of Ser. No. 609,668, Nov. 6, 1990, abandoned, Ser. No. 723,989, Nov. 6, 1990, which is a continuation-in-part of Ser. No. 609,668, Nov. 6, 1990, which is a continuation of Ser. No. 239,734, Sep. 2, 1988, Pat. No. 5,002,482.

[51] Int. Cl.[6] ..... F23D 11/36

[52] U.S. Cl. ..... 431/153; 431/277

[58] Field of Search ..... 431/153, 344, 277, 255; 222/402, 118, 153

[56] References Cited

U.S. PATENT DOCUMENTS

| | | | |
|---|---|---|---|
| 1,895,032 | 1/1933 | Fisher | 431/255 X |
| 2,520,328 | 8/1950 | Nissen | 431/153 X |
| 3,547,566 | 12/1970 | Tamarin | 431/153 X |
| 4,830,603 | 5/1989 | Cirami | 431/277 X |
| 4,921,420 | 5/1990 | Johnston | 222/402.11 |
| 5,217,364 | 6/1993 | Frigiere | 431/344 |
| 5,224,854 | 7/1993 | Ansquer | 431/277 X |

FOREIGN PATENT DOCUMENTS

| | | | |
|---|---|---|---|
| 56-32749 | 8/1981 | Japan | 431/153 |
| 61-62570 | 11/1987 | Japan | 431/153 |

*Primary Examiner*—Carl D. Price

*Attorney, Agent, or Firm*—Pennie & Edmonds

[57] ABSTRACT

A selectively actuatable lighter device is disclosed which includes a body defining reservoir for containing a combustible gaseous medium such as butane, and having a valve arranged to be selectively actuated between a normally closed position and an open position which permits the exit of the gaseous medium. Such lighter can selectively produce sparks at a location proximate to the gaseous medium exit to ignite the gaseous medium. Such lighter device embodies a resiliently releasable latch means which normally prevents actuation of a valve actuator to the open position thereby preventing actuation of the valve. The latch means includes a latch which is selectively movable to a position out of interference with the valve actuator, so that the gaseous medium may be released and ignited by the sparks. The latch means is resiliently structured and mounted such that once the valve actuator is depressed and released, the latch returns to its closed or latched position to prevent actuation of the valve to the open position. To "re-use" the lighter, the latch must again be moved to an unlatched position so that the valve actuator can be opened for subsequent ignition of the gaseous medium.

51 Claims, 9 Drawing Sheets

FIG.1
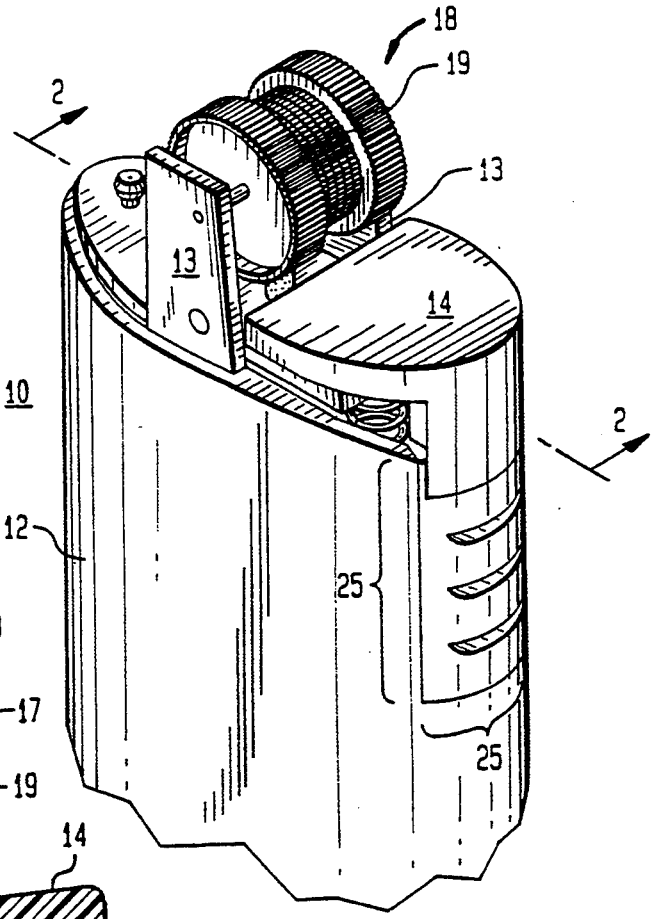
FIG.2
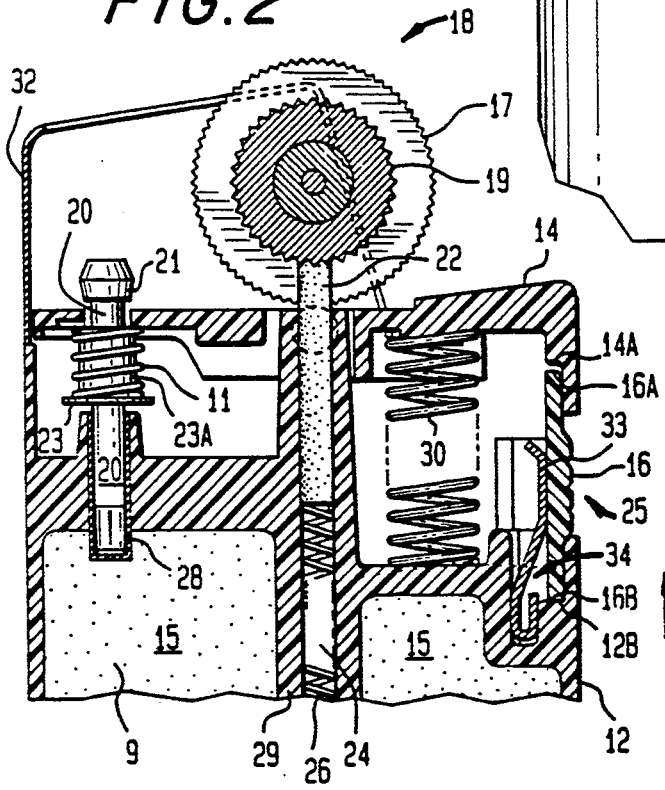
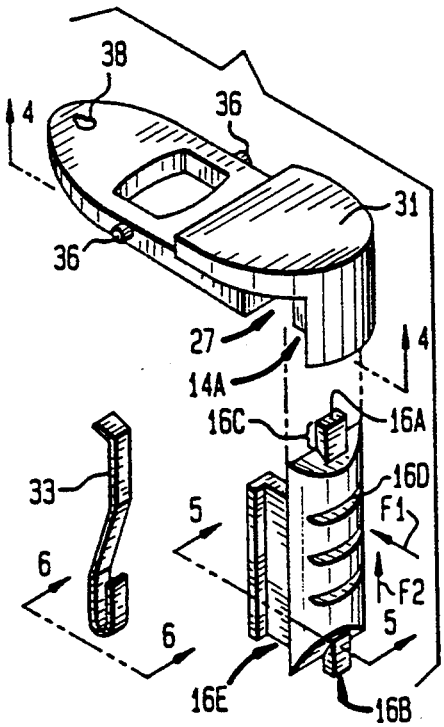
FIG.3

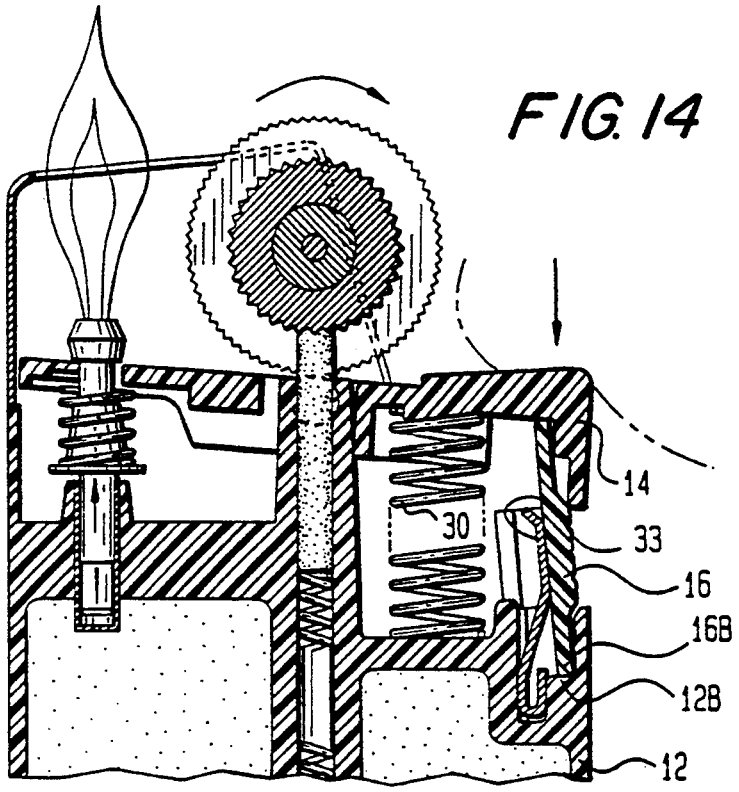
FIG. 14
FIG. 15
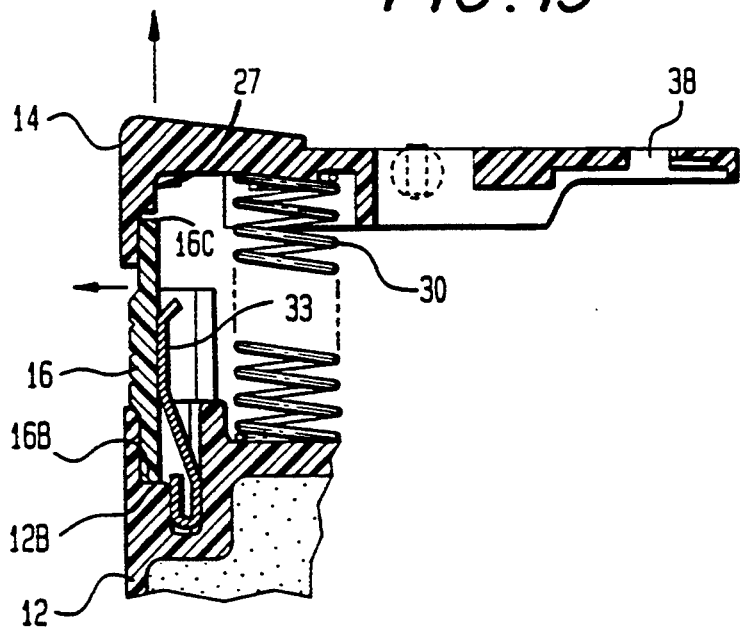

SELECTIVELY ACTUATABLE LIGHTER

CROSS-REFERENCE TO RELATED APPLICATIONS

This is a continuation-in-part of U.S. patent application Ser. No. 07/723,989 filed on Jul. 1, 1991 entitled "Selectively Actuatable Lighter", which is a continuation-in-part of U.S. patent application Ser. No. 07/609,668 filed on Nov. 6, 1990, entitled "Selectively Actuatable Lighter", abandoned, which is a continuation of Ser. No. 07/239,734 filed on Sep. 2, 1988, entitled "Selectively Actuatable Lighter", which issued on Mar. 26, 1991 as U.S. Pat. No. 5,002,482. This is also a continuation-in-part of U.S. patent application Ser. No. 07/912,421, filed on Jul. 10, 1992, entitled "Selectively Actuatable Lighter", which is a continuation of U.S. patent application Ser. No. 07/609,668. Each of these four patent applications is incorporated herein by reference.

This application is also related to U.S. Pat. No. 5,125,829, entitled "Bidirectional Selectively Actuatable Lighter" which issued on Jun. 30, 1992, and U.S. Pat. No. 5,092,764, entitled "Selectively Actuatable Lighter With Locking Value Cap" which issued on Mar. 3, 1992. This application is also related to U.S. patent applications Ser. Nos. 07/965,958, 07/965,596 and 07/965,832, each entitled "Selectively Actuatable Lighter" and each filed concurrently herewith. Each of these two patents and three patent applications is incorporated herein by reference.

BACKGROUND OF THE INVENTION

1. Technical Field

This invention relates generally to lighters which consume fuel such as, for example, butane which is stored in a reservoir in a liquid state, then passed through a valve means and finally ignited by a spark or other similar means. More particularly, the invention relates to a butane cigarette lighter having a feature which interferes with depression of a valve actuator and in turn hinders expulsion of fuel from a valve nozzle (i.e., fuel nozzle) and/or generation of sparks thereby rendering operation of the lighter by young children even more difficult. Advantageously, this feature of the lighter may be deactivated by moving a latch to a non-interfering position, thus facilitating flame production.

2. Description of the Art

Numerous lighters are known, some of them incorporating features which are designed to render operation of the lighter more difficult by certain users. Some of such features relate to mechanisms which are designed to prevent ignition of a fuel source unless the lighter is properly oriented, mechanisms which are designed to automatically turn off a fuel source supply valve, and tamper protection arrangements.

More recently, attention has been directed toward preventing ready actuation of such lighters by persons normally not able to appreciate the potential danger of the flame. Individuals normally contemplated in these efforts are young children, in the age category of younger than five years.

U.S. Pat. No. 4,784,601 to Nitta relates to a gas lighter having an L-shaped slidable stopper which is positionable to prevent descent of a gas lever which controls fuel flow. The lighter is rendered operable by moving the stopper outward so that its vertical leg is displaced from the top surface of the lighter housing. The L-shaped slidable stopper must be manually moved into its locking position each time it is desired to lock the lighter.

U.S. Pat. No. 4,784,602 to Nitta relates to a gas lighter having an L-shaped slidable stopper which is positionable to prevent descent of a gas lever which controls fuel flow. The lighter is rendered operable by moving the stopper inward so that its vertical pin engages a hole in the surface of the lighter housing. The L-shaped slidable stopper must be manually moved into its locking position each time it is desired to lock the lighter.

U.S. Pat. No. 4,786,248 to Nitta relates to a piezoelectric lighter equipped with a thumb-latch slideably fitted within a lighter casing. The thumb latch is manually slidable into and out of a position which interferes with depression of a thumb-pusher. The lighter is rendered operable by manually sliding the thumb-latch to an unlocked position. After operation of the lighter a user must manually slide the thumb-latch to its locked position in order to lock the lighter.

U.S. Pat. No. 4,904,180 to Nitta relates to a piezoelectric lighter equipped with a lock means which automatically returns to a locked position after use of the lighter. The lock means includes a stopper and a leaf-spring which keeps the stopper urged toward the windshield. The lighter may only be operated after the stopper is drawn backwards, away from the windshield. The lighter cannot maintain the stopper in the drawn back position without the application of constant force by a user. That is, no means are provided to maintain the lighter in an unlocked configuration.

U.S. Pat. No. 1,895,032 to Fisher relates to a lighter in which a manual control means is movable out of engagement with a shoulder portion of the lighter so as to enable the manual control means to be depressed thereby causing the lighter to operate. The control means returns to its position in engagement with the shoulder portion after use of the lighter. The lighter cannot maintain the control means in its out of engagement position without the application of constant force by a user.

U.S. Pat. No. 4,830,603 to Cirami relates to a cigarette lighter in which a locking mechanism is provided partially under a valve-actuating pushbutton and extends into a compartment appended to but distinct from a fuel compartment. The locking mechanism relocks itself after each depression of the pushbutton. In particular, one end of a stiffly flexible spring steel wire is held firmly in place in the compartment. Another end of the spring steel wire forms a probe extending into a channel provided in the underside of the pushbutton. The spring steel wire, in a locked configuration, prevents depression of the pushbutton by engaging a low ceiling on the underside of the pushbutton. A portion of the spring steel wire in the form of a loop extending outward from the lighter is accessible by an operator and may be suitably moved by the operator thereby causing the probe to move within the channel in the underside of the pushbutton.

U.S. Pat. No. 4,832,596 to Morris, Sr. relates to a cigarette lighter having a stop member slideably mounted thereon for releasably engaging a gas valve actuating lever. In particular, a spring biased stop member is slidably mounted on a top portion of a conventional disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby causing the fuel to ignite and operating the lighter. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressible valve actuation member of a lighter. These presale tamper protection mechanisms are attached to the lighter housing by frangible webs and are removed by a purchaser after sale of the lighter to expose the spark-producing wheel, fuel nozzle and/or depressible valve actuation member. However, such a presale tamper protection mechanism is of limited value once initially removed by a purchaser.

U.S. Pat. No. 3,547,566 to Tamarin and U.S. Pat. No. 3,899,286 to Lockwood et al. relate to lighters having orientation sensing mechanisms which hinder or prevent actuation of the lighter in an inverted position. Unfortunately, such mechanisms may not provide a sufficient degree of child resistancy to young children who tamper with the lighter since they merely hinder operation in prescribed orientations.

U.S. Pat. No. 4,921,420 to Johnston relates to a disposable lighter having a release means that is physically separated from the conventional lighting means. The lighter may only be operated once the release means is released. The distance separating the release means and the conventional lighting means is intended to be sufficiently large so as to make it difficult for small children to operate the lighter.

U.S. Pat. No. 5,074,781 to Fujita relates to a cigarette lighter having a lock member which must be rotated in a specified direction towards one side of the lighter so as to allow a depressible valve actuator to be depressed and the lighter to operate.

U.S. Pat. No. 5,076,783 to Fremund relates to a lighter having a depressible valve actuator which is coupled to a vertical rod which extends to an opposite end of the lighter where it contacts a locking member. The locking member must first be displaced so as to enable depression of the valve actuator.

U.S. Pat. No. 5,090,893 to Floriot relates to a lighter having a slide member which, when in a first position, prevents depression of a valve actuator. The slide member is slideably movable to a second position in which the valve actuator may be depressed. The slide member is not capable of vertical movement. Additionally, the slide member protrudes from the lighter when in its first position.

Many mechanisms which are designed to render operation of the lighter more difficult by certain users are unnecessarily complicated, present difficulty in their manufacture and/or exhibit a high likelihood of mechanical failure during use. Another disadvantage found in some devices is that the particular construction employed limits the shape and size of the lighter housing due to the requirement that the housing be large enough to accommodate such mechanism(s). Further disadvantages relate to the relative ease with which some mechanisms may be defeated and to the reliability of the mechanisms. For example, some mechanisms may be overridden or removed with relative ease. Additionally, some devices are not equally adaptable for use by both right-handed and left-handed users, and some include inconveniently shaped or positioned levers or knobs which need to be actuated by the user in order to operate the lighter. Furthermore, some of these devices require repositioning of the lighter in an operator's hand after actuation of the mechanism and before the lighter is operated to produce a flame. For example, some lighters include an actuatable mechanism located sufficiently far from a valve actuation means, or on another side of the lighter than the valve actuation means, so as to result in awkward operation of the lighter.

Although it is known to prevent or hinder presale actuation of a depressible valve actuation member or actuation of a lighter in a specified orientation, none of the above-described lighters provides an efficiently manufacturable, relatively small, reliable mechanism for preventing actuation of the depressible valve actuation member and equally adaptable for use by both right-handed and left-handed users.

As will be appreciated, development of a "child-proof" lighter per se is probably not viable. At best, it can be reasonably sought to create a lighter having features which enhance its child-resistant capability, but how "child-resistant" a lighter will be will depend upon many factors and circumstances. Nevertheless, any lighter having features which enhance its child-resistant capability will have limitations with respect to young children, and no such lighter should provide parents or adults with a false sense of security so that they may become less cautious in their handling of the lighter or permit access to the lighter by young children. Further, such lighters should not be made so difficult to light as to cause adults to use alternative forms of lighting, i.e., matches, which are generally considered to be potentially more dangerous.

The present invention is directed toward a reliable flame producing lighter which is selectively actuatable in such a manner as to provide a substantial degree of difficulty for young children—younger than five years—to actuate the lighter and produce a flame, while being user friendly and capable of actuation by adults.

SUMMARY OF THE INVENTION

This invention relates to a selectively actuatable flame producing lighter having a latch means comprising a latch which is normally in a latched position and which is movable to an unlatched or non-interfering position in which the lighter may be operated. The latch is preferably relatively flush mounted with respect to the lighter housing when in its normally latch position. The latch means further comprises a latch biasing means such as a spring for biasing the latch. Advantageously, the latch may be operated with the same finger a user employs to depress a valve actuation lever, without requiring repositioning of the lighter in a user's hand. The lighter is adapted for use by right-handed as well as left-handed users with the same relative ease.

One particular embodiment of the invention relates to a flame producing lighter which comprises a housing defining a reservoir for containing a combustible gaseous medium such as fuel under pressure; valve means arranged for selective actuation between a normally closed position which prevents exit of the gaseous medium from the reservoir, and an open position which permits exit of gaseous medium from the reservoir through the valve means; means for selectively producing sparks at a location proximate the gaseous medium exit opening of the valve means thereby selectively causing ignition of the gaseous medium; means normally positioned for preventing actuation of the valve means to the open position, the valve actuation prevention means being capable of generally vertical movement in the lighter and being movable out of the normal position into a second position only by application of an external force; spring means for applying a biasing force to the valve actuation prevention means; means for selectively moving the valve actuation prevention means to the second position whereby actuation of the valve means to the open position is permitted thereby selectively permitting exit of the combustible gaseous medium from the valve means and ignition of the gaseous medium by sparks produced by the spark producing means, wherein the valve actuation prevention means automatically returns to the normal position after actuation of the lighter. In an alternative embodiment, the valve actuation prevention means is capable of horizontal movement in the lighter, such as movement inward and cross-wise. The lighter preferably includes means to retain the valve actuation prevention means in the second position, thus retaining the lighter in an unlatched configuration. Such retention means may include portions of the housing and/or the spring means and/or portions of the valve actuation prevention means and/or portions of the valve actuator. Additionally, in one embodiment, the valve actuation prevention means of the lighter is constrained to move along only a single path from its normal, or latched, position to the second, or unlatched, position. In an alternative embodiment, such prevention means is movable along two different paths to two different positions in which actuation of the valve means is permitted.

In this embodiment, the valve means is preferably actuated to the open position by actuator means and the means for preventing actuation of the valve means to the open position comprises interference means for preventing movement of the actuator means, the valve actuation interference means being selectively movable to a position out of interference with the valve actuator means. The valve actuation interference means is normally retained in a valve actuation interference position, the movement thereof to the position out of interference with the valve actuator means is resiliently provided by the spring means. Advantageously, the resilient movement of the valve actuation interference means causes the valve actuation interference means to return to its position beneath the valve actuator once the valve actuator is released, thus preventing the valve nozzle from opening. The spring means preferably comprises a spring which applies a biasing force biasing the valve actuation interference means outward.

The valve actuation interference means may take on a variety of forms such as a latch means, a latch or an interference member and may be movable in a variety of directions. Such movement is generally first in one direction, then in another direction. Alternatively, such movement may be in three or more directions, such as any combination of cross-wise, inward, upward and downward movements. For example, the latch may be movable first inward and then upward into a notch or cavity in or near the valve actuator until the valve actuator is depressed, whereby fuel exits the valve and the latch moves back under the valve actuator when the valve actuator is released. Alternatively, the latch may be movable inward and cross-wise to its unlatched position.

The spark producing means of the lighter preferably includes flint material and a rotatable spark-producing wheel which has a toothed surface positioned and arranged to selectively frictionally contact the flint material. Alternatively, the means for selectively producing sparks may be an electric spark-producing means, such as a piezoelectric spark-producing means.

Another embodiment of the invention relates to a flame producing lighter resistant to unauthorized use and normally maintained in a latched configuration comprising a housing; fuel supply means for supplying fuel to be ignited; ignition means for igniting the fuel; valve means for controlling the flow of the fuel; a valve actuator which normally prevents the flow of the fuel when in a first position and is depressible to a second position which permits actuation of the fuel supply means thereby permitting fuel to flow out from the fuel supply means; a latch positioned so as to normally prevent depression of the depressible valve actuator and normally maintain the lighter in the latched configuration; and spring means for applying a biasing force to the latch. Preferably, the latch includes at least a portion normally positioned between at least a portion of the valve actuator and at least a portion of the housing.

In this embodiment, inward movement of the latch enables a tip portion of the latch to become aligned with a cavity in or near the actuator, the cavity being sufficient in size to accommodate the tip portion so as to eventually enable the valve actuator to be depressed.

Such inward movement of the latch is followed by upward movement which causes the aligned tip portion of the latch to enter the cavity and places the lighter in an unlatched configuration in which the valve actuator is capable of being depressed, thereby permitting fuel to flow, the unlatched configuration preferably being resiliently maintained by forces exerted among the latch, the valve actuator, the spring means which biases the latch, and the housing. Alternatively, such inward movement may be followed by cross-wise movement which similarly places the lighter in an unlatched configuration.

Another embodiment of the lighter employs actuator means having a first interfering portion, and means for preventing movement of the actuator means, such prevention means having a finger actuatable portion and a second interfering portion, the first and second interfering portions being normally in alignment with each other thereby preventing movement of the actuator means, the finger actuatable portion being selectively movable so as to move the second interfering portion out of alignment with the first interfering portion, the second interfering portion being normally retained in a valve actuation interference position, the movement thereof to a position out of interference with the valve actuator means being resiliently provided so as to return the second interfering portion to its position in interference with the valve actuator when the valve actuator is released, thus preventing the valve nozzle from opening, and spring means for providing the resilient movement.

In this embodiment, the movement of the finger actuatable portion which causes the second interfering portion to move out of alignment with the first interfering portion is constrained to movement in a single path. The movement of such finger actuatable portion comprises movement first in an inward direction and then movement in an upward direction. Such a lighter preferably includes spring means for retaining the second interfering portion out of alignment with the first interfering portion. Alternatively, two paths may be provided such as inward and cross-wise either to the left or to the right.

Another embodiment of the invention relates to a fuel cut-off mechanism for use in combination with a lighter which comprises means for normally preventing release of fuel from a fuel supply; means for selectively permitting release of the fuel including a depressible valve actuator which upon depression releases the fuel; a latch which normally interferes with depression of the depressible valve actuator, at least a portion of the latch being normally positioned so as to normally interfere with depression of the valve actuator, the latch being arranged such that inward movement of the latch provides a void sufficient in size to enable depression of the valve actuator wherein fuel is permitted to flow; and spring means for supplying a biasing force to the latch. The latch portion is preferably positioned between at least a portion of the valve actuator and at least a portion of a main body housing of the lighter.

Another embodiment of the invention relates to a flame developing lighter comprising a housing; fuel supply means for supplying fuel to be ignited; ignition means for igniting the fuel; valve means for selectively permitting flow of the fuel; and control means for preventing the combination of production of fuel flow and spark generation so as to prevent production of a flame and for permitting production of fuel flow and spark generation to produce a flame.

The control means of this embodiment preferably includes a valve actuator which normally prevents release of the fuel from the fuel supply means when in a first position and is depressible to a second position which permits release of the fuel, the valve actuator having a cavity formed therein; a latch having an interfering portion which is normally in an interfering position thereby preventing depression of the depressible valve actuator; and a spring means for applying a biasing force to the latch. Inward movement of the latch causes the interfering portion to move toward a non-interfering position and further movement in another direction, subsequent to the inward movement, of the latch into the non-interfering position, provides the lighter in an unlatched configuration in which the valve actuator is capable of being depressed, thereby permitting fuel to flow. Such another direction may be, for example, upward, downward, or cross-wise.

The present invention also relates to an improved lighter of the type having valve means for selectively releasing fuel, means for igniting the fuel, valve actuator means for actuating the valve means so as to release fuel, the valve means including a fuel nozzle which expels fuel when the fuel nozzle is lifted upward by the valve actuator means, wherein the improvement comprises a compensator spring which maintains the fuel nozzle in its downward position when the valve actuator is initially actuated. The compensator spring is preferably positioned between the valve actuator means and a portion of the fuel nozzle so as to urge the fuel nozzle downward. The compensator spring is preferably a metallic coiled spring. The fuel nozzle is preferably normally biased downward by the valve actuator means.

In another embodiment, such lighter includes interference means positioned so as to normally interfere with actuation of the valve actuator means, and the compensator spring means compensates for movement of the valve actuator means when the interference means is normally positioned so as to interfere with the actuation of the valve actuator means.

Operation of the lighter requires a certain amount of dexterity and the application of concentrated forces as well as the application of a plurality of forces in multiple directions and in a specified sequence. Additionally, operation of the lighter requires a certain level of cognitive ability.

Furthermore, the lighter of the present invention is a passive latching lighter. Advantageously, the lighter automatically returns to its latched configuration once the depressed valve actuator is released. Thus, the lighter is maintained in an at-rest or default configuration which is latched thereby preventing the flow of fuel and the production of a flame.

Advantageously, the lighter is adapted for use by right-handed as well as left-handed users with the same relative ease. Furthermore, the user may operate the latch mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which like elements are labeled similarly, FIGS. 1–6 and 9–15 depict the lighter of the present invention with one embodiment of the valve actuator and latch means, and FIGS. 16–22 depict the lighter of the present invention with an alternative embodiment of the valve actuator and latch means, and in which:

FIG. 1 is a partial perspective view of a preferred embodiment of a selectively actuatable lighter of the present invention in a latched configuration;

FIG. 2 is a partial cross-sectional view of the lighter of FIG. 1 depicting the latch in a latched configuration;

FIG. 3 is an exploded view of the valve actuator, latch and latch spring means depicted in FIGS. 1 and 2;

FIG. 4 is a bottom view of the valve actuator depicted in FIG. 3;

FIG. 5 is a side view of the latch depicted in FIG. 3;

FIG. 6 is a side view of the latch spring means depicted in FIG. 3;

FIG. 9 is a perspective view of a preferred embodiment of the lighter in an unlatched configuration in which the latch is at its unlatched position thereby permitting depression of the valve actuator so as to permit a valve to open and gas to be released through a fuel nozzle;

FIG. 10 is a perspective view of the lighter of FIG. 9 with the valve actuator in a depressed position and the valve open and depicting a flame;

FIG. 11 is a partial cross-sectional view of the preferred embodiment of the lighter in its latched configuration thereby preventing depression and actuation of the valve actuator;

FIG. 12 is a partial cross-sectional view of the lighter of FIG. 11 in its unlatched configuration and the valve actuator not depressed and the lighter ready for actuation;

FIG. 13 is a partial cross-sectional view of the lighter of FIG. 12 in its partially unlatched configuration and the valve actuator fully depressed so as to permit the flow of fuel;

FIG. 14 is a partial cross-sectional view of the lighter of FIG. 13 in greater detail;

FIG. 15 is a partial cross-sectional view of the lighter of FIG. 13 after the value actuator has been fully depressed and released;

FIG. 16 is a perspective view of a latch for use in an alternative embodiment of the lighter;

FIG. 17 is a bottom view of a valve actuator for use in the alternative embodiment of the lighter;

FIG. 18 is a partial frontal view of the alternative embodiment of the lighter depicting the latch in its latched position;

FIG. 19 is a partial frontal view of the alternative embodiment of the lighter depicting the latch in its unlatched position;

FIG. 20 is a partial cross-sectional view of the alternative embodiment of the lighter depicting the latch in its normally latched position;

FIG. 21 is a partial cross-sectional view of the alternative embodiment of the lighter depicting the latch in its partially unlatched position; and FIG. 22 is a partial cross-sectional view of the alternative embodiment of the lighter depicting the latch in its unlatched position.

DETAILED DESCRIPTION OF THE PREFERRED EMBODIMENT

Figure 4:
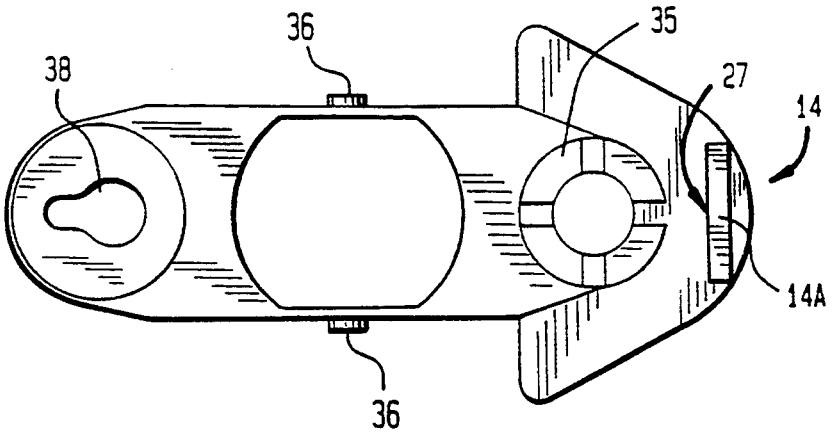

Referring initially to FIG. 1, there is depicted, in a default or at-rest configuration, the lighter 10 of the present invention comprising a main body portion 12, a depressible valve actuator 14, latch 16, and a spark-producing wheel assembly 18 which includes a toothed surface 19. Advantageously, the default configuration is also a latched configuration in which valve actuator 14 cannot be depressed due to the interference presented by latch 16. Depression of valve actuator 14 permits fuel to flow through a fuel nozzle and to be ignited by sparks produced by toothed surface 19 of spark-producing wheel assembly 18 frictionally engaging a flint. Advantageously, unless latch 16 is positioned away from its depicted at-rest or default position and into a non-interfering position, any attempted depression of valve actuator 14 will not result in the flow of fuel and the lighter will be inoperable. The position of latch 16 as shown in FIGS. 1 and 2 may best be characterized as a "default position" under normal conditions.

As will be appreciated, a variety of configurations, shapes and relative positioning exists for the valve actuator and the latch means in which the latch is movable, with respect to the valve actuator, between an interfering or latched position and a non-interfering or unlatched position. The invention will be described in terms of a preferred embodiment in which an illustrative latch normally interferes with depression of the valve actuator when in a latched position, and is movable to an unlatched position in which the valve actuator may be depressed. In this embodiment, the latch is moved from its latched position to its unlatched position along a single path, which is equally suitable for right-handed as well as left-handed users. Such movement is illustratively in an inward direction followed by an upward direction. Alternatively, such movement may be in an inward direction followed by a downward direction, or in an inward direction followed by a cross-wise direction, or in a cross-wise direction followed by a downward direction or in a cross-wise direction followed by an upward direction. Additionally, the reverse of any of these combinations may be employed. For example, the reverse of the inward and then upward movement comprises an upward and then inward movement. Additionally, the latch may be movable along a plurality of paths to a plurality of unlatched positions. As will be appreciated, for ease of understanding, such inward motion of the latch is deemed to include any inward motion or component thereof of any portion of the latch, such upward motion of the latch is deemed to include any upward motion or component thereof of any portion of the latch, and such cross-wise motion of the latch is deemed to include any cross-wise motion or component thereof of any portion of the latch. Additionally, while a first movement may be described as being followed by a separate movement in a different direction, it will be appreciated that such movements or portions thereof can occur simultaneously or overlap each other as in the case of a diagonal movement having inward and upward components. The latch is preferably maintained in its unlatched position after being moved there by a user, and preferably automatically returns to its latched position once a user depresses and releases the valve actuator.

A user typically holds the main body portion of a conventional lighter in his hand, rotates with his thumb the spark-producing wheel in a direction generally toward the depressible surface of the valve actuator to produce a spark, and depresses the valve actuator to allow fuel to pass through the fuel, or valve, nozzle. The spark produced by the wheel ignites the fuel. This is a relatively conventional structure for most lighters, including disposable lighters.

Referring now to FIG. 2, there is depicted a cross-section of the lighter of FIG. 1 in a latched configuration. More particularly, valve actuator 14 is mounted between side wall portions 13 (see FIG. 1) which illustratively comprise extensions of the side walls of body portion 12. Illustratively, valve actuator 14 is pivotally mounted to sidewall portions 13. Valve actuator 14 is attached to hollow fuel nozzle 20 slidably supported within a valve housing 28. Hollow fuel nozzle 20 is held within an opening such as a bore in valve actuator 14 by flange 21, compensator spring means 11 and flange extension 23A. Flange 21 and flange extension 23A each has a sufficient size and is configured so as to prevent slippage of nozzle 20 through the bore in valve actuator 14. Additionally, spring means 11 is maintained as shown in FIG. 2 by flange 23 which is attached to fuel nozzle 20 as is flange 21. A compressed spring means 30 resides beneath valve actuator 14 and causes fuel nozzle 20 to be urged downward into valve housing 28 and body portion 12. In particular, compressed spring 30 causes valve actuator 14 to apply force to spring means 11 which supplies force to flange 23, thereby urging nozzle 20 downward into valve housing 28 and body portion 12 and preventing the flow of fuel through nozzle 20. Additionally, downward movement of value activator 14 in the vicinity of nozzle 20 is limited by contact between the underside of valve actuator 14 and flange extension 23A. In such an embodiment, valve actuator 14 is employed to lift nozzle 20 by the application of force to flange 21 in order to expel fuel. A valve assembly (not fully shown) is located near the recessed end of nozzle 20 and permits fuel to flow through nozzle 20 only when valve actuator 14 is depressed and nozzle 20 lifted.

As will be appreciated, actuation of valve actuator 14 generally results in upward movement of the valve actuator in the vicinity of nozzle 20. However, in the embodiment depicted in FIG. 2, nozzle 20 remains downward during the initial upward movement of valve actuator 14 in the vicinity of nozzle 20 due to the action of compensator spring 11. More specifically, nozzle 20 only moves upward once the valve actuator in the vicinity of nozzle 20 moves upward a sufficient amount such that a top surface of valve actuator 14 in the vicinity of nozzle 20 contacts flange 21. Advantageously, depression of the valve actuator while the lighter is in a latched configuration, while possibly causing the valve actuator in the vicinity of nozzle 20 to move upward due to, for example, a gap between valve actuator interfering portion 14A and latch interfering portion 16A, will not result in any upward movement of the fuel nozzle. Accordingly, fuel will not be released in the event the valve actuator is depressed while the lighter is in a latched configuration. As will be appreciated, such use of a compensator spring is desirable in lighters which incorporate a gap allowing some depression of a latched valve actuator which would otherwise release fuel due to such depression.

Latch 16 is maintained in its latched configuration as depicted in FIGS. 1 and 2 by latch spring means 33 which is positioned within the lighter such that its movement is limited. Illustratively, spring means 33 is firmly attached to housing 12 at cavity 34. As will be shown, latch 16 may only be moved inward by an external force, i.e., a force applied by a user to latch 16, against the force exerted by latch spring means 33 on latch 16.

Lighter 10 further comprises a sparking flint 22 mounted within a bore 24 defined by flint and spring housing 29 in main body 12. Flint 22 is urged toward toothed surface 19 of wheel assembly 18 by spring 26. Spark-producing wheel assembly 18, which includes toothed surface 19 which is preferably suitably hardened and against which flint 22 is urged, is mounted for rotation between side wall extension portions 13 in a conventional manner. Toothed surface 19 includes suitable indentations which define teeth such that when spark-producing wheel assembly 18 is rotated toothed surface 19 cuts against flint 22 causing the generation of ignition sparks. Additionally, spark-producing wheel assembly 18 includes suitable indentations 17 which facilitate rotation of spark-producing wheel assembly 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material or materials, and is preferably constructed from a plastic material. A shield 32, preferably constructed from metal, is provided and functions as a wind guard around the flame thereby assisting in the ignition of the fuel.

As will be appreciated, main body 12 generally encompasses any part, portion, structure or substructure of the lighter except for the valve actuator and spring, spark-producing wheel assembly, flint and spring, valve assembly, and latch means. Accordingly, what will be described as housing interfering portion 12B is deemed to include any such part, portion, etc.

As depicted in FIG. 1 and 2, a notched opening 25 is provided in body portion 12 to accommodate valve actuator 14 and latch 16 and, in particular, vertical movement of valve actuator 14 and inward as well as vertical movement of latch 16. As will be appreciated, FIGS. 1 and 2 depict the lighter in a latched configuration, i.e., a default configuration. In this latched configuration, an interfering portion 16A of latch 16 is positioned beneath an interfering portion 14A of valve actuator 14 and prevents depression of valve actuator 14, thereby preventing actuation of the valve means and thus the release of fuel.

Referring again to FIG. 2, latch 16 is depicted in its latched configuration in which interfering portion 16A of latch 16 is positioned and configured so as to interfere with and prevent depression of valve actuator 14. More specifically, interfering portion 14A of valve actuator 14 contacts interfering portion 16A of latch 16 upon attempted depression of valve actuator 14, thus preventing the release of fuel from fuel nozzle 20. In its latched configuration, latch 16 is prevented from any downward travel by the contact between interfering portion 16B of latch 16 and interfering portion 12B of main body 12. Alternatively, any such downward travel of valve actuator 14 may be prevented by another portion of latch 16 contacting another portion of body 12 or another portion of latch 16 contacting another portion of valve actuator 14. As will be discussed in conjunction with FIGS. 4 and 5, the underside of valve actuator 14 is provided with a notch or cavity 27 suitably shaped for receiving a portion of latch 16 including a tip portion 16C which in turn includes interfering portion 16A.

Referring now to FIG. 3, there is depicted valve actuator 14, latch 16 and latch spring means 33 in greater detail. Valve actuator 14 comprises a finger depressible surface 31, extensions 36, an opening such as a bore 38, and cavity 27. Preferably, cavity 27 is shaped so as to accommodate tip portion 16C of latch 16, including interfering portion 16A. A user desiring to actuate the lighter must first force tip portion 16C into or near cavity 27 by initially applying a component F1 of force to a finger actuatable portion 16D of latch 16 so as to force tip portion 16C inward and into alignment with cavity 27, and then applying a component F2 of force to finger actuatable portion 16D so as to force tip portion 16C upward into cavity 27. The user may then depress finger depressible surface 31.

Extensions 36 are provided to matingly engage with bores in side wall portions 13 of body portion 12 to provide pivotal movement of the valve actuator about extensions 36. Bore 38 is adapted for receiving and grasping a portion of fuel nozzle 20 between flanges 21 and 23. In the latched or closed configuration depicted in FIGS. 1 and 2, an upper surface of interfering portion 16A of latch 16 abuts a lower surface of interfering portion 14A of valve actuator 14, and a lower surface of interfering portion 16B of latch 16 abuts an upper surface of interfering portion 12B of body 12, thereby preventing depression of valve actuator 14. Alternatively, a small gap may be provided between the upper surface of interfering portion 16A of latch 16 and a lower surface of interfering portion 14A of valve actuator 14, or between the lower surface of interfering portion 16B and the upper surface of interfering portion 12B.

Figure 5:
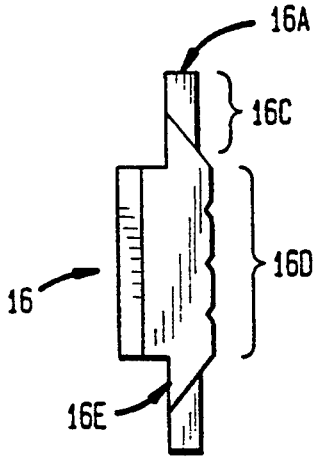

Referring now to FIGS. 3–6, and in particular to FIG. 5, latch 16 is preferably provided with a portion 16E for contact with portion 33A of latch spring 33. More specifically, portion 33A of latch spring 33 applies force to portion 16E of latch 16 so as to normally maintain the lighter in a latched configuration, and also to facilitate retention of the lighter in an unlatched configuration. Alternatively, portion 33A may normally be positioned a slight distance away from latch 16 such that spring 33 is not normally under loading. Additionally, the size, shape, and configuration of latch 16 facilitates stabilization of latch 16 within the lighter and assures proper positioning and retention of latch 16 in notched opening 25 especially when the latch is moved. Finger actuatable portion 16D of latch 16 is employed by a user to move the latch and, in particular, to move tip portion 16C inward and then upward so as to enter cavity 27 of actuator 14.

Advantageously, such a configuration facilitates movement of latch 16 between its latched position and its unlatched position. Additionally, such a configuration facilitates retention of the lighter and, in particular, latch 16, in an unlatched or non-interfering position or configuration once the latch is placed in such an unlatched position or configuration and until valve actuator 14 is depressed and released.

It is desirable that the material from which latch 16 is constructed is relatively inflexible material which will not deform under normal use. Latch 16 is preferably constructed from any sufficiently rigid metal or plastic, although a wide variety of other suitable materials having a sufficient degree of rigidity may be employed.

Referring now to FIG. 4, there is depicted a view of the underside of valve actuator 14 of FIG. 3. A portion 35 of valve actuator 14 is adapted to receive spring 30 as depicted in FIG. 2 and may take on a variety of forms such as a protruding member or, alternatively, an indentation or bore partially into valve actuator 14. The fuel nozzle is illustratively maintained in bore 38 by fuel nozzle flanges 21 and 23 and spring means 11 (FIG. 2) which have a diameter greater than that of a corresponding portion of bore 38. Cavity 27 is formed in the underside of valve actuator 14 as depicted in FIG. 4, and may take on any shape suitable to properly receive tip portion 16C of latch 16.

Valve actuator 14 is constructed from material having sufficient dimensional stability and rigidity to continuously over the life of the lighter assure proper relative positioning between interfering portion 14A of valve actuator 14 and interfering portion 16A of latch 16. Actuator 14 is preferably constructed from zinc or glass-filled polyetherimide. Other illustrative materials from which valve actuator 14 may be constructed are aluminum and other glass filled polymers such as polyethersulfone or the like, as well as combinations of these materials.

Figure 6:
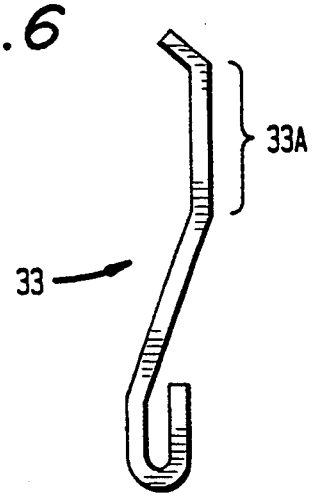

Referring now to FIG. 6, there is depicted a side view of latch spring means 33 in which portion 33A contacts portion 16E of latch 16 (FIGS. 2, 3, 5). Spring means 33 is attached to the lighter housing and is dimensioned and structured to slidably engage portion 16E on latch 16. As will be appreciated, a variety of configurations, shapes and relative positioning exist for spring means 33 in which the spring means normally maintains the lighter in a latched configuration and is resiliently movable to configure the lighter in an unlatched configuration. For example, spring means 33 may be integrally formed with or permanently attached to latch 16. It is desirable that the material from which spring means 33 is constructed is relatively rigid material which is sufficiently resilient to permit movement of latch 16 from its latched position to its unlatched position. Spring means 33 is preferably constructed from any sufficiently resilient elastomer or metal, although a wide variety of other suitable materials having a sufficient degree of elastic memory and a suitable modulus of rigidity may be employed.

Figure 7:
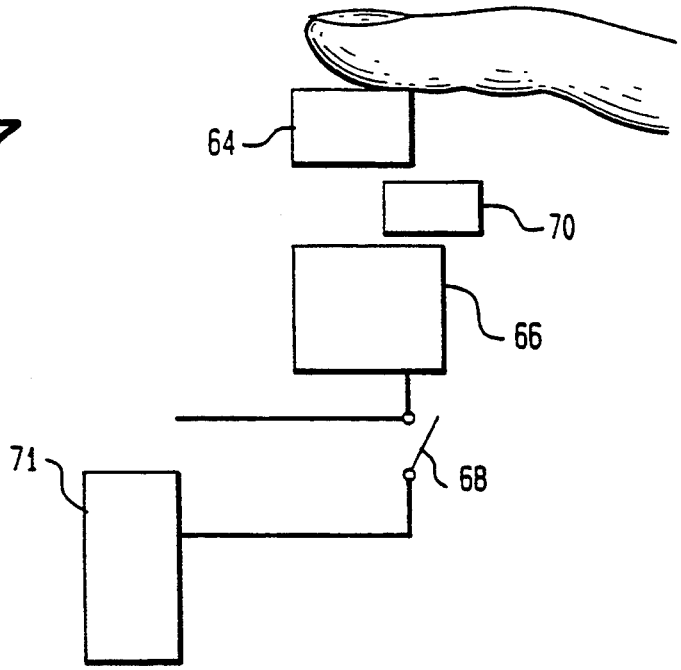
FIG. 7 is a schematic diagram depicting a piezoelectric lighter apparatus in which the present invention may be employed and having an optional switch depicted in the open position and a latch means depicted in the latched position to prevent the production of sparks and the flow of fuel.

FIG. 7 schematically depicts a piezoelectric type lighter in which the present invention may be employed. The piezoelectric lighter comprises hammer and fuel release means 64, spark providing means 66, optional electrical cut-off switch 68, latch means 70 and valve means 71. The piezoelectric lighter operates in a conventional manner except for depression of hammer means 64 which is prevented by inclusion of latch means 70 operative in accordance with the present invention. Illustratively, such latch means comprises a latch and a latch spring means which prevent the production of sparks. In particular, latch means 70 may prevent the production of sparks by electrically and/or mechanically isolating an energy source from the spark producing means. Alternatively, the latch means may be arranged to selectively prevent only the flow of fuel or it may be arranged to selectively prevent both the production of sparks and the flow of fuel. As depicted in FIG. 7, the lighter is in a latched configuration since latch means 70 is positioned so as to prevent actuation of hammer means 64. Additionally, optional switch 68 is depicted in an open, or off, position.

Figure 8:
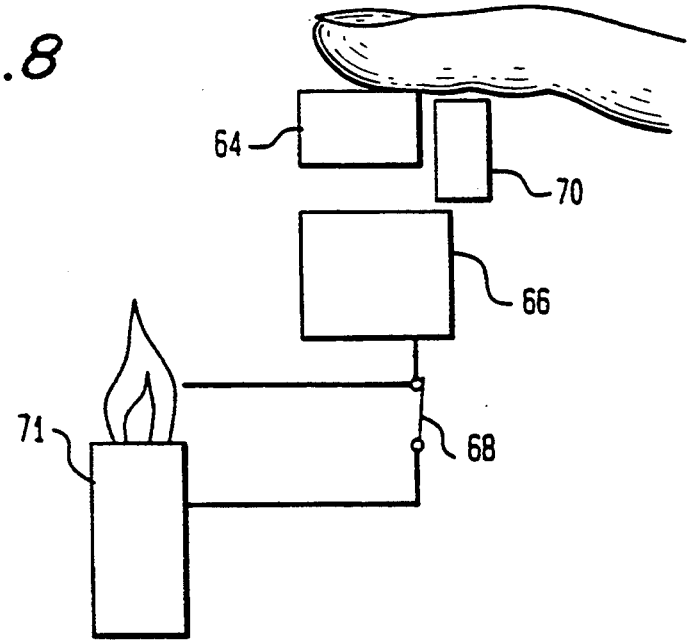
FIG. 8 is a schematic diagram depicting the piezoelectric lighter of FIG. 7 with the switch depicted in the closed position and the latch means depicted in the unlatched position and depicting a flame.

FIG. 8 schematically depicts the piezoelectric type lighter of FIG. 7 in an unlatched configuration. In particular, latch means 70 is positioned so as to enable actuation of hammer means 64. Additionally, switch 68 is depicted in a closed, or on, position. As will be appreciated, incorporation of optional switch 68 requires that it be closed and that latch means 70 be unlatched in order for fuel to be ignited.

Figure 9:
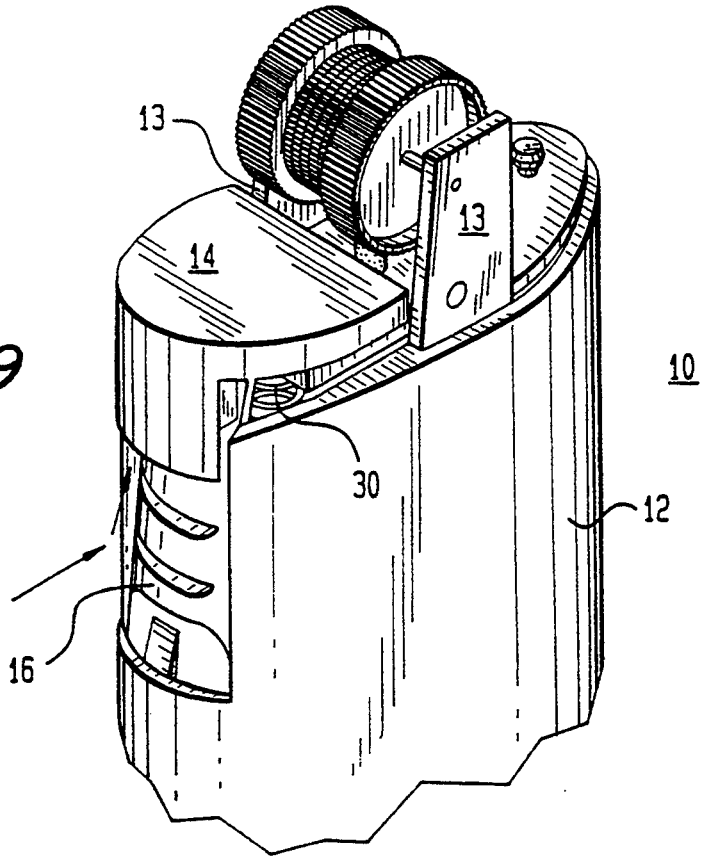
Figure 10:
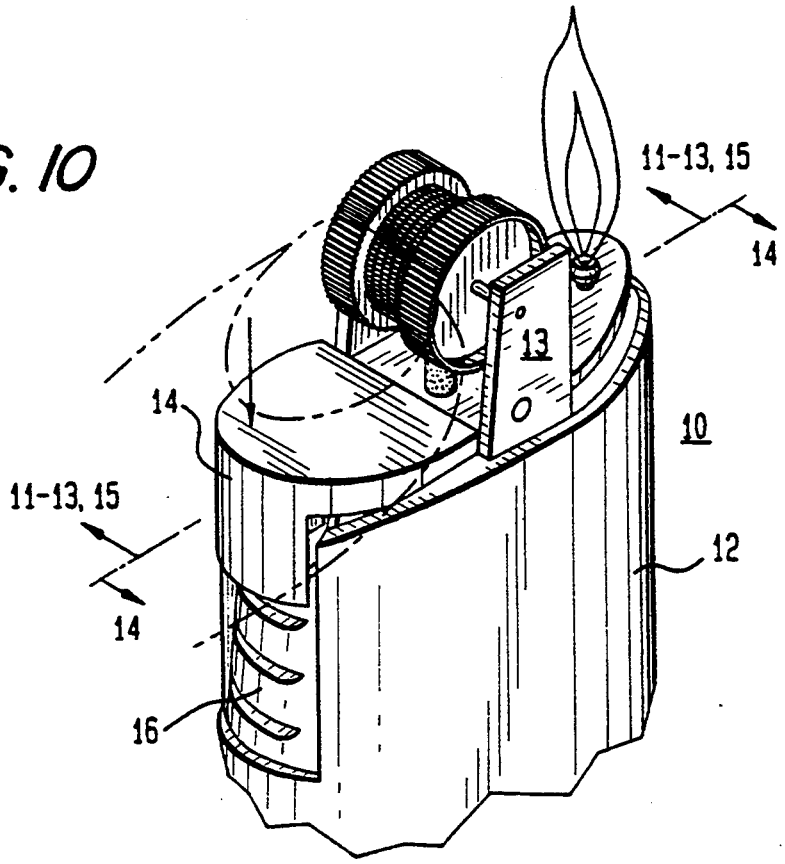

In operation of the present invention, and as depicted in FIGS. 1, 9 and 10, a user must first move latch 16 in an inward direction (FIG. 9) so as to sufficiently displace interfering portion 16A of latch 16 out of interference with interfering portion 14A of actuator 14, and at least partially align tip portion 16C of latch 16 with cavity 27 of actuator 14 so as to ultimately permit depression of valve actuator 14. However, in order to facilitate retention of latch 16 in a non-interfering position, latch 16 is then displaced in an upward direction such that tip portion 16C of latch 16 engages a portion of valve actuator 16 defined by cavity 27 (see also FIGS. 2 and 3). Such an unlatched configuration is depicted in FIG. 9. Depression of valve actuator 14 at this point and suitable rotation of the spark-producing wheel assembly 18 will cause the lighter to operate, and will also cause latch 16 to travel downward as indicated in FIG. 10. In particular, the sparks thus produced will ignite the gaseous fuel which is permitted to be expelled from the fuel nozzle when valve actuator 14 lifts the nozzle thereby actuating the valve. The lifting action of valve actuator 14 in a vicinity near the nozzle releases fuel from the fuel chamber thereby permitting the flow of fuel as a gaseous medium through the nozzle and the subsequent burning of such fuel.

Thus, the presently preferred embodiment of the invention may be placed in an unlatched configuration from its default latched configuration by sufficiently displacing interfering portion 16A relative to interfering portion 14A. This may be accomplished by moving tip portion 16C into engagement or alignment with a portion of valve actuator 14 defined by cavity 27. Advantageously, the path defined by such movement is the same for right-handed and left-handed users, and each of such users may unlatch the lighter with the same relative ease. Thus, this embodiment of the lighter of the present invention enables every user, whether right-handed or left-handed, to actuate the lighter by suitably urging the latch out of interference with the valve actuator.

Figure 11:
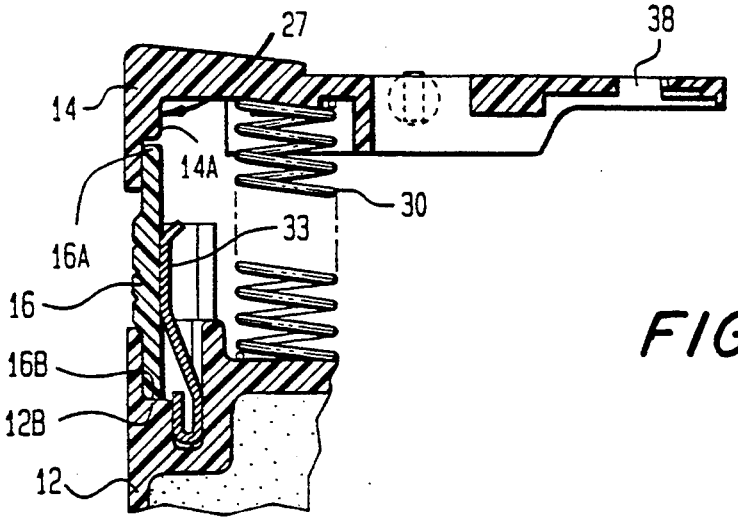

FIGS. 11–15 depict the sequence of operations required for the unlatching of the lighter by positioning tip portion 16C in cavity 27 of actuator 14. In particular, FIG. 11 depicts latch 16 and valve actuator 14 in the default or latched configuration. In this configuration, depression of valve actuator 14 by finger pressure on surface 31 is prevented by the contact between interfering portion 14A of valve actuator 14 and interfering portion 16A of latch 16. As depicted in FIG. 11, interfering portion 16A is positioned directly beneath interfering portion 14A of valve actuator 14 and latch 16 is prevented from any further downward movement since interfering portion 16B of latch 16 abuts interfering portion 12B of body 12. Additionally, FIG. 11 depicts a small gap separating interfering portions 16A and 14A. For ease of illustration, the gap between portions 14A and 16A in the figures is not necessarily drawn to scale. Additionally, such a gap is not necessary for proper operation of the invention.

Figure 12:
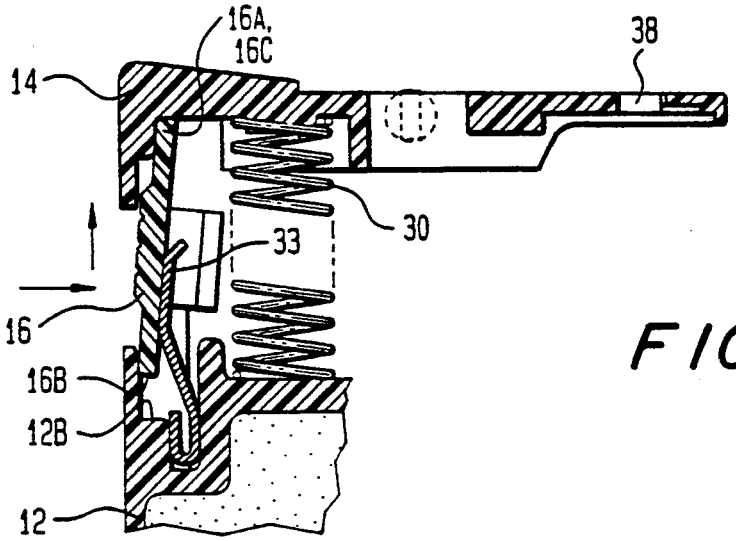

FIG. 12 depicts latch 16 and valve actuator 14 in an unlatched configuration ready for depression of valve actuator 14. Tip portion 16C of latch 16 has been moved inward and upward as indicated by the arrows into engagement with cavity 27 of valve actuator 14. Advantageously, due to, inter alia, the loading which latch 16 is under when tip portion 16C engages part of actuator 14 defined by cavity 27, removal of holding pressure from finger actuatable portion 16D once tip portion 16C has been engaged with, i.e., inserted into, cavity 27 will not result in tip portion 16C or finger actuatable portion 16D slipping toward their respective latched positions but will maintain the lighter in the unlatched configuration depicted in FIG. 12, until valve actuator 14 is depressed. In other words, the lighter may be readied for actuation and flame production by applying suitable force to finger actuatable portion 16D to first move portion 16D in an inward direction and then in an upward direction so as to place tip portion 16C into engagement with cavity 27 of valve actuator 14.

Figure 13:
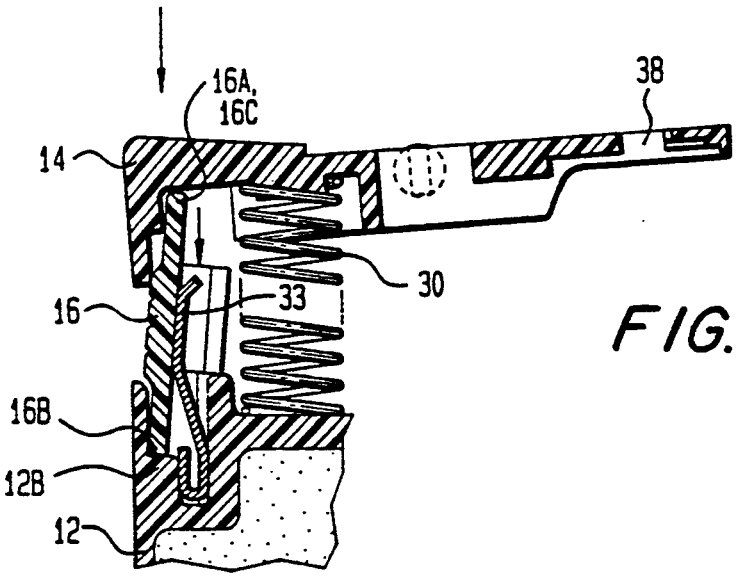

Application of finger pressure to the finger depressible surface of valve actuator 14 as depicted in FIG. 12 will yield the configuration depicted in FIG. 13 in which valve actuator 14 has been depressed thereby permitting fuel to flow through the valve and the fuel nozzle (not shown). In particular, depression of valve actuator 14 urges latch 16 downward toward its partially latched position. Additionally, and as more clearly depicted in FIG. 14, such depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve and out of nozzle 20 whereupon it will have been ignited by sparks produced by flint 22 and toothed surface 19 of spark-producing assembly wheel 18. Such fuel will continue to flow and burn as long as sufficient pressure is maintained on valve actuator 14.

As depicted in FIG. 15, once pressure is removed from valve actuator 14, the valve actuator will move upward due to the biasing force provided by spring 30, and the flame will be extinguished. Advantageously, as valve actuator 14 moves upward, latch 16 remains in the down position since frictional forces between latch 16 and actuator 14 are less than the forces required to lift the latch and overcome, for example, forces between latch 16 and portions of body 12 and forces between latch 16 and latch spring means 33. Once valve actuator 14 moves upward a sufficient amount, tip portion 16C and finger actuatable portion 16D move in an outward direction toward their at-rest or default position.

While FIGS. 1–6 and 9–15 depict the lighter of the present invention with one embodiment of a valve actuator and latch means that operates by moving a latch inward and upward, FIGS. 16–22 depict the lighter of the present invention with an alternative embodiment of the valve actuator and latch means that operates by moving a latch inward and cross-wise.

Figure 16:
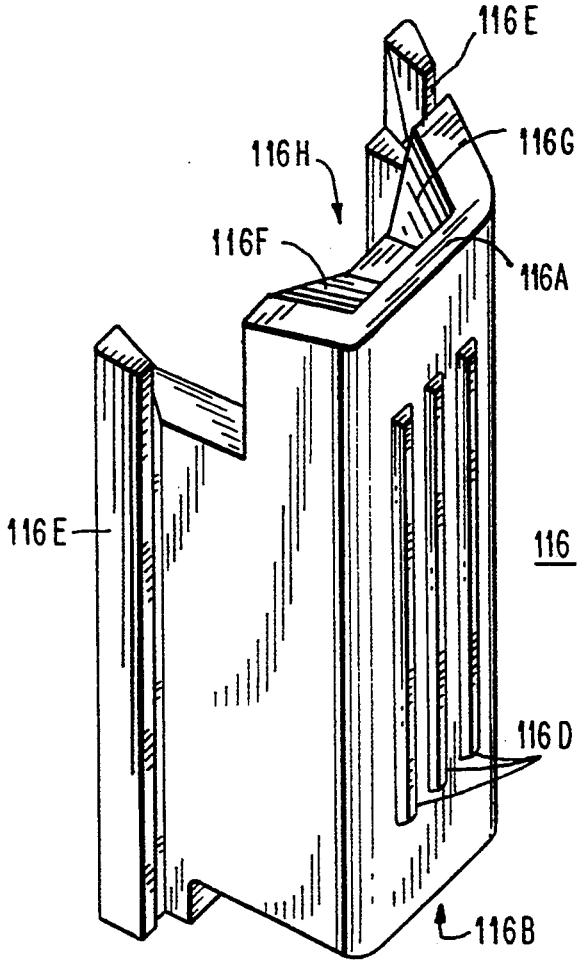

More specifically, FIG. 16 depicts a latch 116 having an interfering or tip portion 116A, another interfering portion 116B, a finger actuatable portion 116D, retaining structure 116E, sloped surfaces 116F and 116G, and cavity 116H partially defined by sloped surfaces 116F and 116G.

Figure 17:
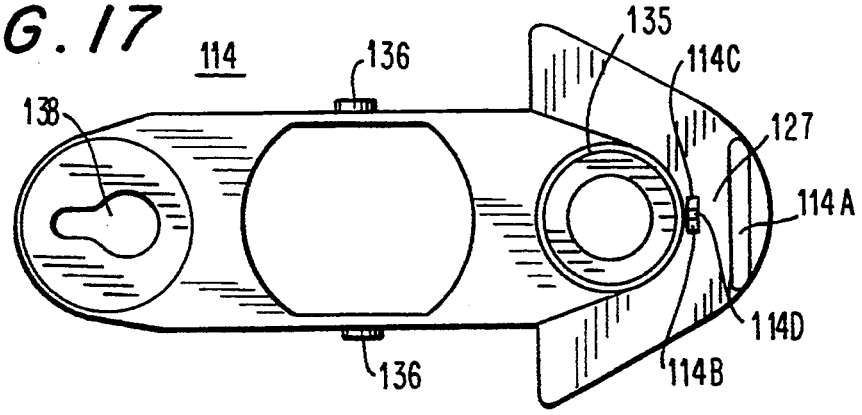

FIG. 17 depicts the underside of valve actuator 114. Portion 135 is adapted to receive spring 30 as depicted in FIG. 2, the fuel nozzle is maintained in bore 138 and extensions 136 facilitate pivotal movement of the valve actuator. Valve actuator 114 includes interfering portion 114A, sloped surfaces 114B and 114C, flat surface 114D, and cavity 127. Sloped surfaces 114B and 114C and flat surface 114D are configured so as to result in a trapezoidal protrusion away from valve actuator 114.

Figure 19:
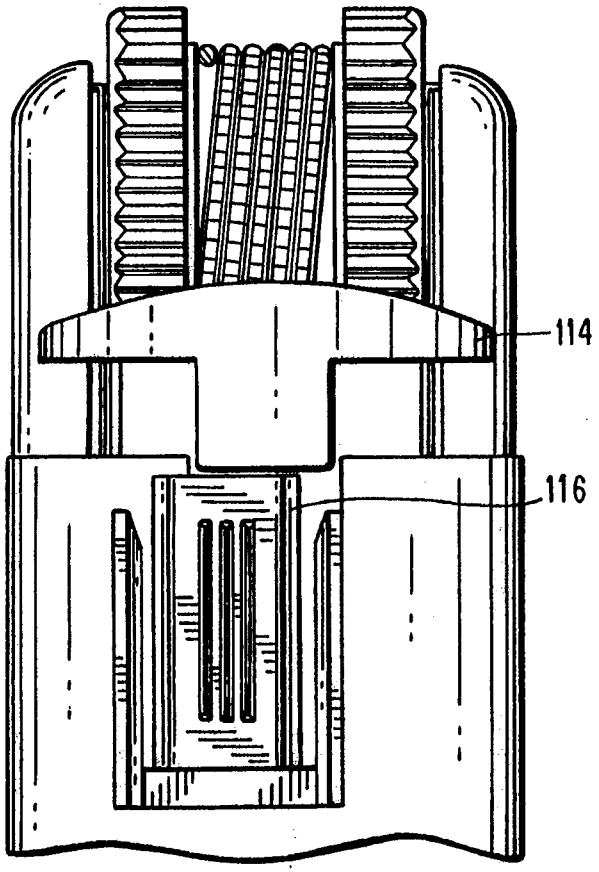
Figure 18:
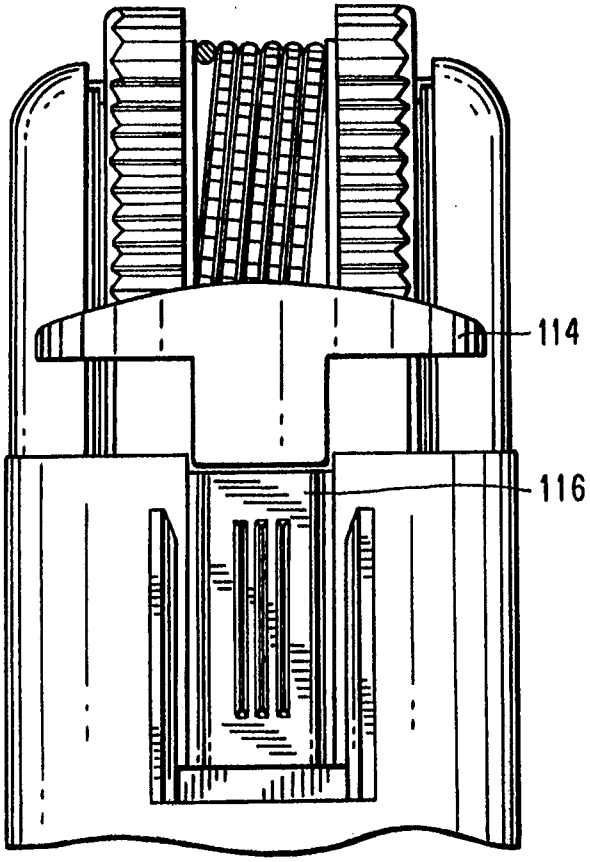

FIG. 18 schematically depicts the lighter in its at-rest and latched position in which the valve actuator cannot be depressed due to the alignment of valve actuator interfering portion 114A with latch interfering portion 116A. FIG. 19 schematically depicts the lighter in its unlatched position in which the valve actuator can be depressed since latch interfering portion 116A has been moved inward and cross-wise so as to be out of alignment with valve actuator interfering portion 114A.

Figure 20:
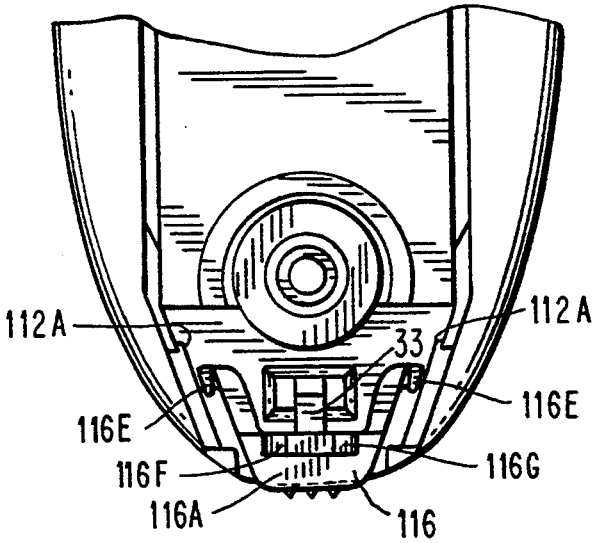
Figure 21:
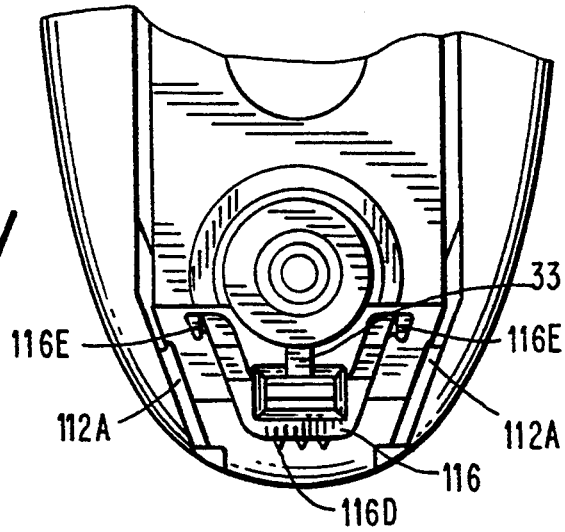
Figure 22:
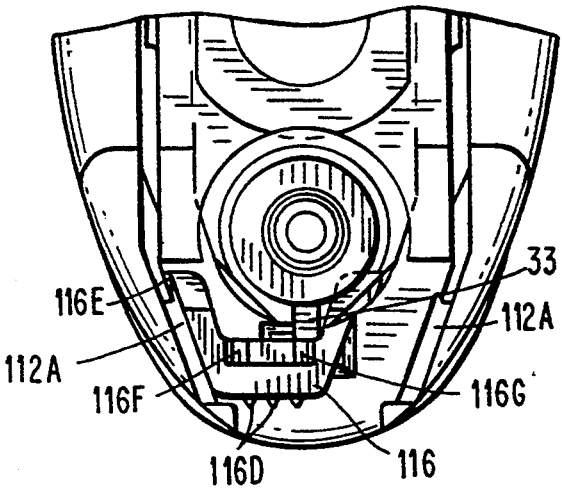

FIGS. 20–22 depict the sequence of operations required for the unlatching of the lighter by positioning latch interfering portion 116A out of interference with valve actuator interfering portion 114A and into alignment with cavity 127 of actuator 114. In particular, FIG. 20 depicts latch 116 in the default or latched position. In this configuration, depression of valve actuator 114 is prevented by the contact between interfering portion 114A of valve actuator 114 (see FIG. 17) and interfering portion 116A of latch 116. The latch is prevented from downward movement due to contact between interfering portion 116B (see FIG. 16) and a portion of the lighter housing (not shown).

FIG. 21 depicts latch 116 moved inward from its position depicted in FIG. 20. As will be appreciated, a user must apply a sufficient amount of force to latch 116 so as to overcome the biasing force of spring 33 in order to obtain the configuration depicted in FIG. 21. As will also be appreciated, removal of holding pressure on portion 116D of latch 116 as depicted in FIG. 21 will cause latch 116 to move outward toward its latched position.

FIG. 22 depicts latch 116 in its unlatched position, moved cross-wise from its position depicted in FIG. 21. As will be appreciated, removal of holding pressure on portion 116D of latch 116 as depicted in FIG. 22 will not cause the latch to move to its latched position due to the interaction between latch retaining structure 116E and housing portion 112A. As depicted in FIG. 22, valve actuator interfering portion 114A (see FIG. 17) is out of interference with latch interfering portion 116A.

As will be appreciated, depression of the valve actuator once the lighter is placed in the unlatched configuration depicted in FIGS. 19 and 22, will cause the latch to move cross-wise thereby unhooking latch retaining structure 116E from housing portion 112A. More specifically, depression of the valve actuator will cause the protrusion of valve actuator 114 formed by sloped surfaces 114B and 114C and flat surface 114D to contact latch sloped surface 116G and force latch 116 cross-wise toward its center position. In particular, valve actuator sloped surface 114B will urge latch sloped surface 116G in a direction so as to move latch 116 cross-wise toward its central position. As will be appreciated, a wide variety of surfaces, protrusions or notches in valve actuator 114 and latch 116 may be employed to cause the lighter to automatically return to its latched configuration after use. Additionally, a spring means may be employed to bias the latch so as to facilitate its return to its latched position.

While FIG. 22 depicts the latch in an unlatched position which is generally toward the left of FIG. 22, the latch could alternatively be moved inward and cross-wise so as to be in an unlatched position which is generally toward the right of FIG. 22. In such a configuration, depression of the valve actuator would cause valve actuator sloped surface 114C to urge latch sloped surface 116F in a direction so as to move latch 116 cross-wise toward its central position. As will be appreciated, such a lighter is equally adapted for use by right-handed as well as left-handed users.

While it is apparent that the invention herein disclosed is well-calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the latch means and lighter disclosed and claimed herein are not limited to use in disposable lighters. Moreover, the present invention is not limited to a latch means in which a latch is moved first in an inward direction then in an upward direction ninety degrees from the inward direction, or first in a cross-wise direction, then in an inward direction and then in an upward direction, or first in an inward direction and then in a cross-wise direction, in order to align an interfering portion of the latch with a cavity in the valve actuator so as to enable depression of the actuator. For example, any of a wide variety of latches or actions may be employed, such as latches having right-left, front-rear, over and down, in and over, over and up, etc. type actions, or any of such actions coupled with an inward movement. Similarly, the latch may be positioned at other locations within the lighter body so as to prevent depression of the valve actuator by interfering with other portions of the valve actuator. For example, the latch may be positioned at a side of the lighter as opposed to the rear of the lighter depicted in the figures.

We claim:

1. A flame producing lighter resistant to unauthorized use and normally maintained in a latched configuration comprising:

an elongated housing having a fuel compartment;

fuel supply means for supplying fuel from said fuel compartment;

ignition means for igniting said fuel;

valve means for controlling the flow of said fuel;

a valve actuator operatively engaged with said valve means such that fuel is released when said valve actuator is depressed along a longitudinal axis of said housing from a first position to a second position;

a latch positioned between said valve actuator and a portion of said housing for normally preventing said valve actuator from being depressed along the longitudinal axis of said housing, thereby maintaining said lighter in said latched configuration;

spring means for applying an outward biasing force to said latch perpendicular to the longitudinal axis of said housing;

wherein inward movement of said latch towards the longitudinal axis of said housing enables a tip portion of said latch to become aligned with a cavity in said valve actuator, said cavity being sufficient in size to accommodate said tip portion so as to enable said valve actuator to be depressed, and wherein upward movement along the longitudinal axis of said housing, subsequent to said inward movement, of said latch causes said aligned tip portion of said latch to enter said cavity and places said lighter in an unlatched configuration.

2. The flame producing lighter according to claim 1 wherein said ignition means comprises a spark-producing wheel and a flint urged against said wheel and wherein sparks are produced by rotation of said wheel.

3. The flame producing lighter according to claim 1 wherein said ignition means comprises electric spark-producing means.

4. The flame producing lighter according to claim 1 wherein said ignition means comprises piezoelectric spark-producing means.

5. The flame producing lighter according to claim 1 wherein said latch is constrained to move along only a single path when said lighter is configured from said latched configuration to said unlatched configuration.

6. The flame producing lighter according to claim 1 wherein said spring means comprises a spring which supplies a force biasing said latch outward.

7. The flame producing lighter according to claim 1 wherein said unlatched configuration is resiliently maintained by force applied by said spring means.

8. The flame producing lighter according to claim 1 wherein said latch has a portion normally positioned between at least a portion of said valve actuator and at least a portion of said housing, said latch portion normally preventing depression of said valve actuator.

9. A flame producing lighter which comprises:

a housing defining a reservoir for containing a combustible gaseous medium under pressure;

valve means for releasing the combustible gaseous medium from said reservoir;

valve actuation means operatively engaged with said valve means for actuating said valve means from a closed position to an open position such that when said valve actuation means is depressed along a longitudinal axis of said housing the gaseous medium is released through said valve means, said valve actuation means including a cavity formed therein;

means for igniting said gaseous medium;

a latch having a finger actuatable portion and a tip portion connected thereto, said latch being positioned so as to interfere with tho movement of said valve actuation means along the longitudinal axis of the housing for preventing actuation of said valve means to the open position, said finger actuatable portion being movable inward toward the longitudinal axis of said housing so as to move said tip portion out of interference with said valve actuation means and into alignment with said cavity; and spring means for retaining said tip portion in said out of interference position.

10. The flame producing lighter according to claim 9 wherein said finger actuatable portion of said latch is movable inward and upward so as to move said tip portion into engagement with said cavity.

11. The flame producing lighter according to claim 9 wherein said finger actuatable portion is constrained to move along only a single path as said tip portion is moved out of interference with said valve actuation means.

12. The flame producing lighter according to claim 9 wherein said latch is positioned beneath at least a portion of said valve actuation means so as to interfere with the movement of said valve actuation means.

13. A flame producing lighter which comprises:

a housing defining a reservoir for containing a combustible gaseous medium under pressure;

valve means for releasing the combustible gaseous medium from said reservoir;

means for igniting said combustible gaseous medium;

actuator means operatively engaged with said valve means for actuating said valve means from a closed position to an open position such that when said valve actuator means is depressed along a longitudinal axis of said housing the gaseous medium is released through said valve means, said actuator means including a first interfering portion;

means for preventing the movement of said actuator means along the longitudinal axis of said housing, said means for preventing having a finger actuatable portion and a second interfering portion, said first and second interfering portions being normally in alignment, said finger actuatable portion being selectively movable inward towards and upward along the longitudinal axis of said housing so as to move said second interfering portion out of alignment with said first interfering portion; and spring means for resiliently urging said second interfering portion outward away from the longitudinal axis.

14. A lighter having a fuel cut-off mechanism, said fuel cut-off mechanism comprising:

(a) means for normally preventing the release of fuel;

(b) means for selectively permitting the release of fuel, said means for selectively permitting including:

(i) a depressible valve actuator which, upon depression along a longitudinal axis of said lighter, actuates the release of fuel;

(ii) a latch which normally prevents the depression of said valve actuator along the longitudinal axis of said lighter by having at least a portion of said latch positioned between at least a portion of said valve actuator and at least a portion of a main body housing of said lighter; and (iii) spring means for urging said latch outward away from the longitudinal axis of said lighter, wherein inward movement of said latch towards the longitudinal axis of said lighter provides a void between at least a portion of said valve actuator and at least a portion of said housing, said void being sufficient in size to enable said valve actuator to be depressed, and wherein upward movement of said latch along the longitudinal axis of said lighter, subsequent to said inward movement causes said valve actuator to resiliently maintain said latch so as to place said lighter in an unlatched configuration.

15. The fuel cut-off mechanism of claim 14 wherein said spring means retains said lighter in said unlatched configuration by applying a biasing force to said latch.

16. The fuel cut-off mechanism of claim 14 further comprising means for constraining said movement of said latch to a single path equally suitable for both right-handed and left-handed users.

17. A flame developing lighter comprising:

(a) a housing defining a fuel compartment;

(b) fuel supply memos for supplying fuel from said fuel compartment;

(c) ignition means for igniting said fuel;

(d) valve means for selectively permitting flow of said fuel; and (e) means for selectively unlatching said lighter from a normally latched configuration in which fuel is prevented from flowing, said means for selectively unlatching said lighter including:

(i) a valve actuator which normally prevents release of fuel from said fuel supply when in a first position and is depressible along a longitudinal axis of said housing to a second position which permits release of said fuel;

(ii) a latch which normally prevents depression of said valve actuator along the longitudinal axis of said housing, said latch having an interfering portion being normally positioned in alignment with an interfering portion of said valve actuator thereby preventing depression of said valve actuator; and (iii) spring means for applying a biasing force to said latch, wherein inward movement of said interfering portion of said latch towards the longitudinal axis of said housing moves said interfering portion of said latch out of alignment with said interfering portion of said valve actuator, and wherein upward movement along the longitudinal axis of said housing, subsequent to said inward movement, of said latch, provides said lighter in an unlatched configuration in which said valve actuator is capable of being depressed.

18. The flame developing lighter according to claim 14 wherein said ignition means comprises a spark-producing wheel and a flint urged against said wheel and wherein sparks are produced by rotation of said wheel.

19. The flame developing lighter according to claim 14 wherein said ignition means comprises electric spark-producing means.

20. The flame developing lighter according to claim 14 wherein said ignition means comprises piezoelectric spark-producing means.

21. The flame developing lighter of claim 14 wherein said spring means retains said lighter in said unlatched configuration by applying a biasing force to said latch.

22. The flame developing lighter of claim 14 further comprising means for constraining said movement of said latch to a single path equally suitable for both right-handed and left-handed users.

23. A flame developing lighter comprising:

(a) a housing having a fuel reservoir;

(b) fuel supply means for supplying fuel to be ignited from said fuel reservoir;

(c) ignition means for igniting said fuel;

(d) valve means for selectively permitting flow of said fuel; and (e) control means for preventing fuel flow and ignition, said control means including:

(i) a valve actuator which normally prevents escape of said fuel from said fuel supply means when said valve actuator is in a first position, said valve actuator being depressible along a longitudinal axis of said housing to a second position which permits actuation of said fuel supply means thereby permitting fuel to flow out from said fuel supply means;

(ii) a latch having an interfering portion which is normally in an interfering position with said valve actuator thereby preventing depression of said depressible valve actuator along the longitudinal axis of said housing; and (iii) spring means for applying a biasing force to said latch, wherein inward movement of said latch towards the longitudinal axis of said housing causes said interfering portion to move toward a non-interfering position and wherein further movement in a second direction, subsequent to said inward movement, of said latch into the non-interfering position provides said lighter in an unlatched configuration.

24. The flame developing lighter according to claim 23 wherein said ignition means comprises a spark-producing wheel and a flint urged against said wheel and wherein sparks are produced by rotation of said wheel.

25. The flame developing lighter according to claim 23 wherein said ignition means comprises electric spark-producing means.

26. The flame developing lighter according to claim 23 wherein said ignition means comprises piezoelectric spark-producing means.

27. The flame developing lighter of claim 23 wherein said another direction is upward.

28. The flame developing lighter of claim 27 wherein movement of said latch is limited to movement in a single path.

29. The flame developing lighter of claim 23 wherein said spring means retains said lighter in said unlatched configuration by applying a biasing force to said latch.

30. A flame developing lighter comprising:

(a) a housing having a fuel reservoir;

(b) fuel supply means for supplying fuel to be ignited from said fuel reservoir;

(c) ignition means for igniting said fuel;

(d) valve means for selectively permitting flow of said fuel; and (e) control means for preventing fuel flow and ignition, said control means including:

(i) a valve actuator operatively engaged with said valve means and which normally prevents release of said fuel from said fuel supply means when in a first position, said valve actuator being depressible along a longitudinal axis of said housing to a second position so as to permit the flow of fuel from said fuel supply means;

(ii) a latch having an interfering portion which is normally in an interfering position thereby preventing depression of said valve actuator; and (iii) spring means for applying a biasing force to said latch, wherein movement of said latch in a first direction followed by movement of said latch in a second direction followed by movement of said latch in a third direction, subsequent to said first and second movements, one of said movements being in a direction along said longitudinal axis of the housing, into a non-interfering position, said non-interfering position being resiliently maintained, provides said lighter in an unlatched configuration in which said valve actuator is capable of being depressed, thereby permitting fuel to flow.

31. The flame developing lighter of claim 30 wherein movement of said latch is limited to movement in a single path.

32. The flame developing lighter of claim 30 wherein said spring means retains said lighter in said unlatched configuration by applying a biasing force to said latch.

33. A flame producing lighter which comprises:

a housing defining a reservoir for containing a combustible gaseous medium under pressure;

valve means for permitting the release of fuel from said reservoir;

a depressible valve actuator operatively engaged with said valve means and which actuates said valve means between a normally closed position which prevents exit of said gaseous medium from said reservoir, and an open position which permits exit of gaseous medium from said reservoir through said valve means;

means for selectively producing sparks at a location proximate the gaseous medium exit opening of said valve means;

an interference member which normally prevents depression of said valve actuator along a longitudinal axis of said housing, said interference member being movable inward towards the longitudinal axis of said housing whereby depression of the valve actuator is permitted thus selectively permitting actuation of said valve means and exit of said combustible gaseous medium from said valve means;

spring means for retaining said member in the valve actuation position at least until said valve means is moved to the open position; and means for returning said member to the valve actuation prevention position once said valve actuator is depressed and released.

34. A flame producing lighter which comprises:

a housing defining a reservoir for containing fuel under pressure;

valve means operatively arranged with said reservoir for selective actuation between a normally closed position which prevents exit of said fuel from said reservoir, and an open position which permits exit of said fuel from said reservoir through said valve means;

means for selectively producing sparks at a location proximate the gaseous medium exit opening of said valve means;

means normally positioned for preventing actuation of said valve means to the open position, said valve actuation prevention means being movable inward and cross-wise with respect to a longitudinal axis of said lighter, into a second position;

spring means, independent of said valve actuation prevention means, for applying a biasing force to said valve actuation prevention means, wherein said cross-wise movement of the valve actuation prevention means is a movement relative to said spring means; and means for selectively moving said valve actuation prevention means to said second position whereby actuation of said valve means to the open position is permitted, wherein the resilient movement of said valve actuation interference means facilitates said valve actuation interference means to return to its position beneath said valve actuator once the valve actuator is released, thus preventing the valve means from opening.

35. The flame producing lighter according to claim 34 wherein said valve means is actuated to the open position by actuator means and said means for preventing actuation of said valve means to the open position comprises interference means for preventing movement of said actuator means, said valve actuation interference means being selectively movable to a position out of interference with said valve actuator means.

36. The flame producing lighter according to claim 35 wherein said valve actuation interference means is normally retained in a valve actuation interference position, the movement thereof to said position out of interference with said valve actuator means being resiliently provided by said spring means.

37. The flame producing lighter according to claim 34 wherein said valve actuation interference means is a latch movable inward and cross-wise toward a cavity in said valve actuator until said valve actuator is depressed, whereby fuel exits said valve means and the latch moves back under the valve actuator to its interference position when the valve actuator is released.

38. The flame producing lighter according to claim 34 further comprising means to retain said valve actuation prevention means in said second position.

39. The flame producing lighter according to claim 34 wherein said spring means comprises a spring which applies a force biasing said valve actuation prevention means outward.

40. The flame producing lighter according to claim 34 wherein said valve actuation prevention means is movable along two different paths to two different positions in which actuation of said valve means to the open position is permitted.

41. A flame producing lighter resistant to unauthorized use and normally maintained in a latched configuration comprising:

a housing having fuel supply means for supplying fuel to be ignited;

ignition means for igniting said fuel;

valve means for controlling the flow of said fuel;

a valve actuator operatively engaged with said valve means which normally prevents the flow of said fuel when said valve actuator is in a first position, said valve actuator being depressible along a longitudinal axis of said housing to a second position which permits actuation of said fuel supply means thereby permitting fuel to flow out from said fuel supply means;

a latch positioned so as to normally prevent depression of said valve actuator and normally maintain said lighter in said latched configuration;

spring means for applying a biasing force to said latch, wherein a first, inward movement of said latch towards the longitudinal axis of said housing enables an interfering portion of said latch to move out of alignment with an interfering portion of said actuator, and wherein a second, cross-wise movement with respect to the longitudinal axis of said housing, subsequent to said inward movement, of said latch places said lighter in an unlatched configuration in which said valve actuator is capable of being depressed, thereby permitting fuel to flow.

42. The flame producing lighter according to claim 41 wherein said ignition means comprises a spark-producing wheel and a flint urged against said wheel and wherein sparks are produced by rotation of said wheel.

43. The flame producing lighter according to claim 41 wherein said ignition means comprises electric spark-producing means.

44. The flame producing lighter according to claim 41 wherein said ignition means comprises piezoelectric spark-producing means.

45. The flame producing lighter according to claim 41 wherein said latch is able to move along two different paths to two different unlatched positions.

46. The flame producing lighter according to claim 41 wherein said spring means comprises a spring which supplies a force biasing said latch outward.

47. The flame producing lighter according to claim 41 wherein said unlatched configuration is resiliently maintained.

48. The flame producing lighter according to claim 41 wherein said latch has a portion normally positioned between at least a portion of said valve actuator and at least a portion of said housing, said latch portion normally preventing depression of said valve actuator.

49. A lighter having a fuel cut-off mechanism, said fuel cut-off mechanism comprising:

(a) means for releasing fuel from a fuel supply; and (b) means for selectively permitting actuation of said fuel supply, such selective actuation of said fuel supply and a corresponding production of sparks by spark-producing means causing fuel from said fuel supply to be ignited, said actuation permitting means including:

(i) a depressible valve actuator which, upon depression along a longitudinal axis of said lighter, actuates said fuel supply thereby permitting fuel to flow out from said fuel supply;

(ii) a latch which normally prevents depression of said depressible valve actuator, at least a portion of said latch being normally positioned between at least a portion of said valve actuator and at least a portion of a main body housing of said lighter thereby preventing depression of said valve actuator; and (iii) spring means for applying a biasing force to said latch, wherein inward movement of said latch towards the longitudinal axis of said housing followed by cross-wise movement of said latch with respect to the longitudinal axis of said housing toward a position being resiliently maintained, provides said lighter in an unlatched configuration in which said valve actuator is capable of being depressed, thereby permitting fuel to flow.

50. A flame developing lighter comprising:

(a) a housing having a fuel reservoir;

(b) fuel supply means for supplying fuel to be ignited from said fuel reservoir;

(c) ignition means for igniting said fuel;

(d) valve means for selectively permitting flow of said fuel; and (e) means for selectively unlatching said lighter from a normally latched configuration in which fuel is prevented from flowing, said means for selectively unlatching said lighter including:

(i) a valve actuator which normally prevents release of fuel from said fuel supply when in a first position and is depressible along a longitudinal axis of said housing to a second position which permits release of said fuel;

(ii) a latch which normally prevents depression of said depressible valve actuator, said latch having an interfering portion being normally positioned in alignment with an interfering portion of said valve actuator thereby preventing depression of said valve actuator; and (iii) spring means for applying a biasing force to said latch, wherein inward movement of said interfering portion of said latch towards the longitudinal axis of said housing moves said interfering portion of said latch out of alignment with said interfering portion of said valve actuator, and wherein cross-wise movement with respect to the longitudinal axis of said housing, subsequent to said inward movement, of said latch, provides said lighter in an unlatched configuration in which said valve actuator is capable of being depressed, thereby permitting fuel to flow.

51. The fuel cut-off mechanism of claim 14 further comprising means for constraining said movement of said latch to a single path equally suitable for both right-handed and left-handed users.

* * * * *

UNITED STATES PATENT AND TRADEMARK OFFICE
CERTIFICATE OF CORRECTION

PATENT NO. : 5,445,518

DATED : August 29, 1995

INVENTOR(S) : McDonough et al.

It is certified that error appears in the above-identified patent and that said Letters Patent is hereby corrected as shown below:

Front page: change the following paragraph from:

"The portion of the term of this patent subsequent to Mar. 26, 2008 has been disclaimed."

to:

--The portion of the term of this patent subsequent to Oct. 10, 2012 has been disclaimed.--

Signed and Sealed this

Fourteenth Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,445,518

DATED : August 29, 1995

INVENTOR(S) : James M. McDonough

It is certified that errors appear in the above-identified patent and that said Letters Patent is hereby corrected as shown below:

Claim 17, line 3 (col. 20, line 44): change "memos" to --means--.

Claim 18, line 2 (col. 21, line 10): change "14" to --17--.

Claim 19, line 2 (col. 21, line 14): change "14" to --17--.

Claim 20, line 2 (col. 21, line 17): change "14" to --17--.

Claim 21, line 1 (col. 21, line 19): change "14" to --17--.

Claim 22, line 1 (col. 21, line 22): change "14" to --17--.

Cancel claim 51.

Signed and Sealed this

Ninth Day of March, 1999

*Attest:*

Q. TODD DICKINSON

*Attesting Officer*

*Acting Commissioner of Patents and Trademarks*